United States Patent [19]

Conan et al.

[11] Patent Number: 5,013,412

[45] Date of Patent: May 7, 1991

[54] PROCESS FOR THE ELECTROSYNTHESIS OF A BETA,GAMMA-UNSATURATED ESTER

[75] Inventors: Annie Conan, Bagneux; Esther D'Incan, Chatenay-Malabry; Jacques Perichon, Savigny-sur-Orge; Soline Sibille, Saint-Maur-des-Fosses, all of France

[73] Assignee: Societe Nationale des Poudres et Explosies (SNPE), Paris, France

[21] Appl. No.: 510,879

[22] Filed: Apr. 18, 1990

[30] Foreign Application Priority Data

Apr. 28, 1989 [FR] France ..... 89 05626

[51] Int. Cl.[5] ..... C25B 3/00

[52] U.S. Cl. ..... 204/59 R; 204/72

[58] Field of Search ..... 204/59 R, 72

[56] References Cited

U.S. PATENT DOCUMENTS 3,764,492 10/1973 Baizer et al. ..... 204/72
4,097,344 6/1978 Drury ..... 204/59 R
4,400,566 8/1983 Colon ..... 204/72
4,629,541 12/1986 Moingeon et al. ..... 204/59 R
4,686,018 8/1987 Chaussard ..... 204/59 R

*Primary Examiner*—John F. Niebling
*Assistant Examiner*—Steven P. Marquis
*Attorney, Agent, or Firm*—Cushman, Darby & Cushman

[57] ABSTRACT

The invention relates to a process for the electrosynthesis of a beta,gamma-unsaturated ester by electrolysis, in a cell having only a single compartment, of a mixture of an alpha,beta-unsaturated halide and an alpha-halogenated ester in the presence of an amount which is less than the stoichiometric amount for the reaction between the halide and the ester of a catalyst based on nickel complexed with a binitrogenous bidentate organic ligand.

The anode, which is consumed by the electrochemical reaction of which it is the center, is made of a metal chosen from the group comprising the reducing metals and their alloys and is preferably made of zinc, aluminum or magnesium.

This process, which is simple and economical, in particular permits the synthesis of arylacetates and arylpropionates, which are intermediates in the synthesis of pharmaceutical or plant protection products.

20 Claims, No Drawings

PROCESS FOR THE ELECTROSYNTHESIS OF A BETA,GAMMA-UNSATURATED ESTER

The invention relates to a process for the electrosynthesis of a beta,gamma-unsaturated ester from an alpha-halogenated ester and an alpha,beta-unsaturated halide, carried out in an electrolytic cell in an organic solvent medium.

The beta,gamma-unsaturated esters, such as, for example, the arylacetates and arylpropionates, are, in particular, intermediates in the synthesis of pharmaceutical or plant protection products.

FR 2,573,072 describes, in particular, the chemical synthesis of arylacetates and arylpropionates by reaction of an alpha-halogenated ester and an organonickel complex of formula $ArNiXL_2$ in which Ar represents an aryl group, X a halogen atom and L a tertiary phosphine.

The complex is prepared in an electrolytic cell having separate compartments, by reduction, in an organic solvent medium, of a nickel halide and an aromatic halide in the presence of tertiary phosphine in accordance with the reaction:

$$ArX + NiX_2 + L_2 + 2e^- \rightarrow ArNiXL_2 + 2X^-$$

The anode is inert and the reaction requires the presence of a supporting electrolyte.

According to this process, the organonickel complex is not a catalyst but a reactant used in a stoichiometric amount, that is to say it is not possible to obtain, in moles, more beta,gamma-unsaturated ester than organonickel complex used. However, this complex is expensive and of low stability.

Moreover, the synthesis of arylpropionates and arylacetates from ArX and alpha-halogenated esters requires 2 steps, a first electrochemical step for the synthesis of the organonickel complex followed by a second purely chemical step.

The aim of the present invention is to propose a simple and economical process for the synthesis, in a single step, of a beta,gamma-unsaturated ester such as, for example, an arylacetate or an arylpropionate, from an alpha-halogenated ester and an alpha,beta-unsaturated halide, such as, for example, an aromatic halide or a vinyl halide.

The process, according to the present invention, for the electrosynthesis of a beta,gamma-unsaturated ester from an alpha-halogenated ester and an alpha,beta-unsaturated halide, carried out in an electrolytic cell fitted with electrodes in an organic solvent medium, is characterized in that a mixture of an alpha,beta-unsaturated halide and an alpha-halogenated ester is electrolyzed in the presence of an amount which is less than the stoichiometric amount for the reaction between the halide and the ester of a catalyst based on nickel complexed with a binitrogenous bidentate organic ligand, in an electrolytic cell having only a single compartment and fitted with a sacrificial anode made of a metal chosen from the group comprising the reducing metals and their alloys.

An "amount which is less than the stoichiometric amount for the reaction between the alpha,beta-unsaturated halide and the alpha-halogenated ester" is understood to be an amount in moles, less than the maximum number of moles of beta,gamma-unsaturated ester able to form, that is to say an amount, in moles, less than the lowest amount between the number of moles of alpha-halogenated ester and the number of moles of alpha,beta-unsaturated halide present, since one mole of beta,gamma-unsaturated ester is obtained by reaction of one mole of alpha-halogenated ester and one mole of alpha,beta-unsaturated halide.

A "non-compartmented cell" is understood to be a cell in which the anode and cathode compartments are not separated and form only a single and sole compartment.

A sacrificial anode is understood to be an anode which is consumed, in a quasi-stoichiometric manner, in the course of the electrochemical reaction of which it is the center. An anode of this type is sometimes termed a "soluble" anode.

"Their alloys" are understood to be any alloy containing at least one reducing metal.

The unsaturation in the alpha,beta-unsaturated halide can be, for example, of an ethylenic character or can be part of an aromatic or hetero-aromatic ring.

The process according to the invention, which is simple and inexpensive, thus enables a beta,gamma-unsaturated ester to be obtained in a single step from an alpha-halogenated ester and an alpha,beta-unsaturated halide, which, relative to the known processes, constitutes a very significant technical advance.

Preferably, the anode is made of a metal chosen from the group comprising zinc, aluminium, magnesium and their alloys, that is to say any alloy containing at least zinc, aluminium or magnesium.

Preferably, the beta,gamma-unsaturated ester has the general formula

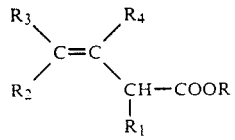

in which:

R represents a substituted or unsubstituted aliphatic or aromatic chain, preferably an alkyl chain preferably containing 1 to 8 carbon atoms, for example a methyl, ethyl, n-propyl, isopropyl, n-butyl, isobutyl, pentyl, hexyl, heptyl or octyl chain, optionally substituted by a $C_1$–$C_4$ chain.

$R_1$ represents hydrogen or a substituted or unsubstituted aliphatic chain, preferably an alkyl chain preferably containing 1 to 4 carbon atoms, for example a methyl, ethyl, n-propyl, isopropyl, n-butyl or isobutyl chain. $R_1$ preferably represents hydrogen or the methyl group.

$R_2$ represents hydrogen or a substituted or unsubstituted aliphatic or aromatic chain, preferably an alkyl chain preferably containing 1 to 4 carbon atoms, for example a methyl, ethyl, n-propyl, isopropyl, n-butyl or isobutyl chain.

$R_3$ and $R_4$, which may be identical or different, represent hydrogen or a substituted or unsubstituted aliphatic or aromatic chain or, and preferably, $R_3$ and $R_4$ form, together with the carbon atoms to which they are bonded, a substituted or unsubstituted aromatic cyclic or heterocyclic radical, for example a phenyl, naphthyl, pyridinyl or thiophenyl ring, optionally substituted, for example, by at least one ether group, such as $—OCH_3$, $—OC_2H_5$ or $—OC_3H_7$, ketone group, such as

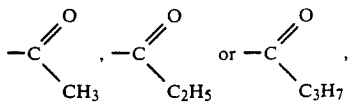

nitrile group or alkyl group, such as $—CH_3$, $—C_2H_5$, $—C_3H_7$, $—C_4H_9$ or $—CF_3$.

When $R_3$ or $R_4$ represents an aliphatic chain, the latter can be, for example, an alkyl chain preferably containing 1 to 4 carbon atoms, for example a methyl, ethyl, n-propyl, isopropyl, butyl or isobutyl chain.

When $R_3$ or $R_4$ represents an aromatic chain, the latter can be, for example, a phenyl, naphthyl, pyridinyl or thiophenyl ring, optionally substituted, for example, by at least one ether group, such as $—OCH_3$, $—OC_2H_5$ or $—OC_3H_7$, ketone group, such as

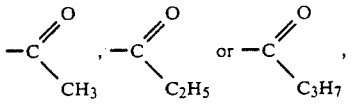

nitrile group or alkyl group such as $—CH_3$, $—C_2H_5$, $—C_3H_7$, $—C_4H_9$ or Preferably, the alpha,beta-unsaturated halide has the general formula

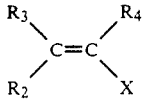

in which $R_2$, $R_3$ and $R_4$ have the abovementioned meaning and X represents a chlorine, bromine or iodine atom, preferably a bromine or iodine atom, and the alpha-halogenated ester has the general formula

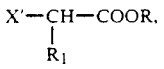

which R and $R_1$ have the abovementioned meaning and X' represents a chlorine, bromine or iodine atom.

Particularly preferantially, the alpha,beta-unsaturated halide is an aromatic bromide, an aromatic iodide, a vinyl chloride, a vinyl bromide or a vinyl iodide and the alpha-halogenated ester is a chloroacetate which is unsubstituted or monosubstituted in the alpha-position.

The reaction equation representing the reaction carried out in the process according to the present invention is as follows:

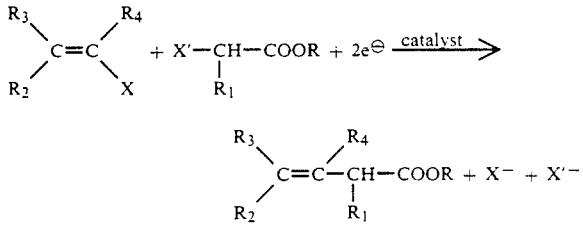

Preferably, a molar excess of alpha-halogenated ester relative to the alpha,beta-unsaturated halide is used, but it is also possible to operate under stoichiometric conditions.

The catalyst based on nickel complexed with a binitrogenous bidentate organic ligand is, for example, obtained by mixing a nickel salt, for example a nickel halide such as nickel chloride or nickel bromide, and a binitrogenous bidentate organic ligand. It is also possible to use a nickel perchlorate or nickel fluoborate as the nickel salt, without this being restricting. The nickel salt is sometimes marketed in a ligand form, for example $NiBr_2(DME)_2$ in which DME represents a dimethoxyethane ligand.

The binotrogenous bidentate organic ligand is preferably 2,2'-bipyridine (Bipy), but it is also possible to use, for example, ortho-phenanthroline or tetramethylethylenediamine (TMEDA). The nickel salt and the ligand are preferably used in stoichiometric amounts, but it is also possible, for example, to use an excess of ligand.

The catalyst can be prepared and isolated independently. It can also be produced in situ in the reaction mixture for the electrosynthesis of the beta,gamma-unsaturated ester. The amount of catalyst used is less than the stoichiometric amount for the reaction between the alpha,beta-unsaturated halide and the alpha-halogenated ester. Preferably between 1 and 20% of catalyst is used relative to the stoichiometric amount, preferably approximately 10%.

Surprisingly, it has been found that better yields are obtained when the alpha-halogenated ester is added progressively in the course of the electrolysis or when the reaction is carried out in the presence of a salt of a reducing metal, such as, for example, a zinc salt.

The concentration, in the organic solvent, of alpha,-beta-unsaturated halide and alpha-halogenated ester is arbitrary. It is generally between 0.1 and 0.5 M.

The inert cathode is any metal, such as stainless steel, nickel, platinum, copper, gold, or graphite. The cathode preferably consists of a cylindrical grating or sheet arranged concentrically around the anode.

The electrodes are supplied with direct current via a stabilized supply.

The organic solvents used within the framework of the present invention are the not very protic solvents customarily used in organic electrochemistry. The following may be mentioned for example: dimethylformamide (DMF), acetonitrile, N-methylpyrrolidone (NMP), hexamethylphosphorotriamide (HMPT) and the mixtures of these compounds. DMF is preferably used.

It is not essential to add a supporting electrolyte to the reaction mixture, the latter being sufficiently conductive. This constitutes a distinct advantage and contributes to the simplicity of the process according to the invention. However, a supporting electrolyte can be added in order to render the mixture more conductive. In this case the supporting electrolytes used are those customarily used in organic electrochemistry. The following may be mentioned for example: the salts in which the anion is a halide, a perchlorate or a fluoroborate and the cation is a quaternary ammonium, lithium, sodium, potassium, magnesium, zinc or aluminium.

The current density on the cathode is preferably chosen between 0.2 and 5 $A/dm^2$. Preferably, the electrolysis is carried out at constant intensity, but it is also possible to operate at constant voltage, at controlled potential, or with variable intensity and potential.

The invention is illustrated by the non-limiting examples which follow.

A conventional non-compartmented cell is used to carry out these examples.

The upper part of the cell is made of glass and is fitted with 5 tubes which permit the intake and outlet of gas, sampling of the solution in the course of electrolysis if desired, electrical feed-throughs and the feeding of the anode through a central tube. The lower portion consists of a stopper fitted with a Teflon joint screwed onto the upper glass portion.

The useful volume is approximately 35 $cm^3$.

The anode is a cylindrical bar approximately 1 cm in diameter which is immersed in the solution over a length of about 3 cm. It is in an axial position relative to the cell.

The cathode consists of a carbon fabric arranged concentrically around the anode. Its apparent surface area is of the order of 20 $cm^2$.

The solvent is purified by distillation under vacuum.

The solution is stirred with a bar magnet and the electrolysis takes place at ambient temperature.

The products obtained are determined, isolated, purified and identified by conventional methods.

EXAMPLES 1 to 17

Synthesis of various beta,gamma-unsaturated methyl propionates 30 cc of DMF, 10 mmol of alpha,beta-unsaturated halide, 20 mmol of methyl alpha-chloropropionate, 0.5 mmol of tetrabutylammonium bromide and 1 mmol of catalyst $NiBr_2Bipy$ are introduced into the cell.

The solution is degassed by bubbling argon through it and is then kept under an inert atmosphere of argon by maintaining a slight excess pressure of this gas.

The solution is then electrolyzed at a constant intensity of 200 mA until the alpha,beta-unsaturated halide disappears, which is checked by gas phase chromatography.

The reaction mixture is then hydrolyzed with 100 cc of a 3% aqueous solution of hydrochloric acid and is then extracted with 3 times 70 cc of diethyl ether.

After combining the ether phases, these are washed with distilled water, dried over $MgSO_4$ and the mixture thus obtained is then concentrated under a partial vacuum.

The product obtained is then purified by chromatography on a silica column and is then identified, in particular by proton nuclear magnetic resonance and mass spectrometry.

The following table specifies, for each example, the nature of the alpha,beta-unsaturated halide, the nature of the sacrificial anode, the nature of the beta,gamma-unsaturated methyl propionate obtained and the corresponding yield of isolated and purified beta,gamma-unsaturated methyl propionate, expressed relative to the starting alpha,beta-unsaturated halide and determined by weighing the product.

For Example 2, 5 mmol of $ZnCl_2$ were added to the reaction mixture.

For Example 6, methyl alpha-chloropropionate is added dropwise continuously in the course of the electrolysis.

| EX No. | Alpha, beta-unsaturated halide | Anode | Beta, gamma-unsaturated methyl propionate | Yld (%) |
|---|---|---|---|---|
| 1 | 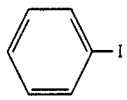 | Zn | 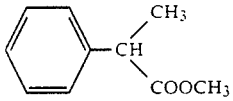 | 53 |
| 2 | | Mg | | 60 |
| 3 | | Al | | 40 |
| 4 | | | | 65 |
| 5 | 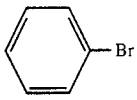 | Al | | 30 |
| 6 | | | | 40 |
| 7 | 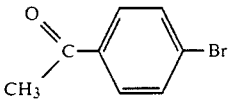 | Zn | 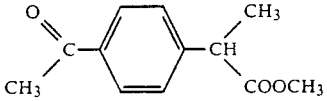 | 11 |
| 8 | | Al | | 13 |
| 9 | 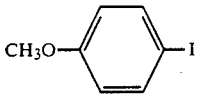 | Al | 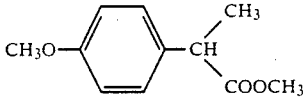 | 85 |
| 10 | 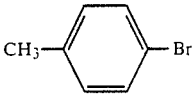 | Al | 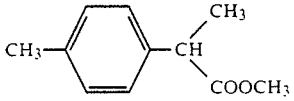 | 15 |
| 11 | 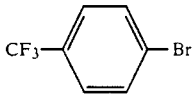 | Al | 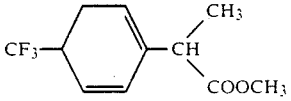 | 66 |

-continued

| EX No. | Alpha, beta-unsaturated halide | Anode | Beta, gamma-unsaturated methyl propionate | Yld (%) |
|---|---|---|---|---|
| 12 | 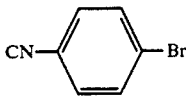 | Al | 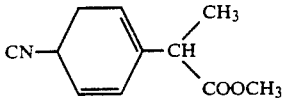 | 70 |
| 13 | 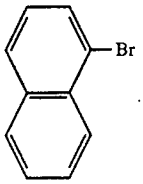 | Al | 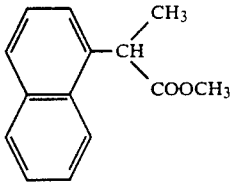 | 40 |
| 14 | 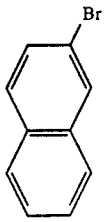 | Al | 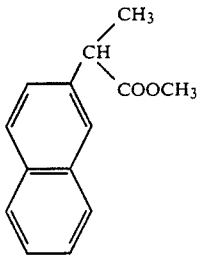 | 35 |
| 15 | 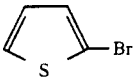 | Al | 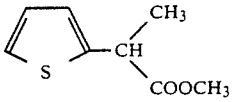 | 40 |
| 16 | 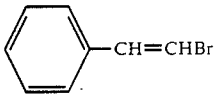 | Al | 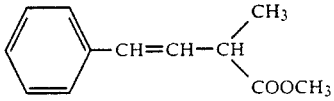 | 60 |
| 17 | 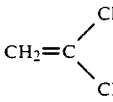 | Al | 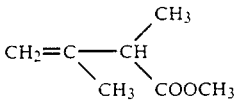 | 25 |

EXAMPLE 18

Synthesis of methyl 2-phenylpropionate from methyl alpha-bromopropionate

The electrolysis is carried out under the same conditions as those in Example 4 but using methyl alpha-bromopropionate in place of methyl alpha-chloropropionate. The yield is 26% of isolated pure product.

EXAMPLE 19

Influence of the solvent

The electrolysis is carried out under the same conditions as those of Example 12, but acetonitrile is used as the solvent in place of DMF. The yield of pure methyl 2-paracyanophenylpropionate isolated is 28%.

EXAMPLES 20 and 21

Influence of the concentration of the catalyst

For Example 20, the electrolysis is carried out under the same conditions as those of Example 12, but 0.1 mmol of $NiBr_2Biby$ is used in place of 1 mmol (i.e. 1% relative to the stoichiometric amount in place of 10%). The yield of pure methyl 2-paracyanophenylpropionate isolated is 60%.

For Example 21, the electrolysis is carried out under the same conditions as those of Example 5, but on the one hand 5 mmol of $NiBr_2Biby$ are used in place of 1 mmol and on the other hand the electrolysis is carried out in the absence of tetrabutylammonium bromide.

The yield of pure methyl 2-phenylpropionate isolated is 30%. This example also shows that it is possible to carry out the electrolysis in the absence of the addition of a carrier electrolyte to the reaction mixture.

EXAMPLE 22 and 23

Influence of the nature of the catalyst

The electrolysis is carried out under the same conditions as those of Example 4, but using as the catalyst, in place of $NiBr_2Bipy$, $NiCl_2$-ortho-phenanthroline for Example 22 and $NiBr_2$-(TMEDA) for Example 23. For Example 23, the catalyst is obtained in situ in the reaction mixture by introducing 1 mmol of $NiBr_2$-$(DME)_2$ and 1 mmol of TMEDA.

The yield of pure methyl 2-phenylpropionate isolated is 73% for Example 22 and 10% for Example 23.

EXAMPLES 24 to 26

Synthesis of methyl phenylacetate

For Example 24, the electrolysis is carried out under the same conditions as those of Example 4 but replacing methyl alpha-chloropropionate by methyl alpha-chloroacetate.

Methyl phenylacetate is obtained in a yield of 70% of isolated pure product.

For Example 25, the electrolysis is carried out under the same conditions as those of Example 24 but replacing the aluminum anode by a zinc anode and tetrabutylammonium bromide (0.5 mmol) by tetrabutylammonium tetrafluoroborate (1 mmol).

Methyl phenylacetate is obtained in a yield of 65% of isolated pure product.

For Example 26, the electrolysis is carried out under the same conditions as those of Example 25 but replacing iodobenzene by bromobenzene.

Methyl phenylacetate is obtained in a yield of 20% of isolated pure product.

We claim:

1. A process for the electrosynthesis of a beta, gamma unsaturated ester from an alpha, beta unsaturated halide and an alpha halogenated ester, said process comprising electrolyzing, in an electrolytic cell fitted with electrodes in an organic solvent medium, a mixture of an alpha, beta unsaturated halide and an alpha halogenated ester in the presence of an amount, which is less that the stoichiometric amount for the reaction between said halide and said ester, of a catalyst based on nickel complexed with a binitrogenous bidentate organic ligand, said electrolytic cell having only a single compartment and being fitted with a sacrificial anode made of a reducing metal or an alloy thereof.

2. The process of claim 1 wherein said anode is made of a reducing metal selected from the group consisting of zinc, aluminum, magnesium and an alloy thereof.

3. The process of claim 1 wherein (1) said beta, gamma unsaturated ester has the formula

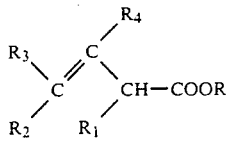

wherein

R represents a substituted or unsubstituted aliphatic or aromatic chain, $R_1$ represents hydrogen or a substituted or unsubstituted aliphatic chain, $R_2$ represents hydrogen or a substituted or unsubstituted aliphatic or aromatic chain, $R_{3\ pl\ and\ R4}$, each independently, represent hydrogen or a substituted or unsubstituted aliphatic or aromatic chain, or $R_{3\ pl\ and\ R4}$, together with the carbon atoms to which they are bonded, form a substituted or unsubstituted aromatic cyclic or heterocyclic radical;

(2) said alpha, beta unsaturated halide has the formula

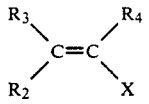

wherein $R_2$, $R_3$ and $R_4$ have the meanings given above and X represents a chlorine, bromine or iodine atom; and (3) said alpha halogenated ester has the formula

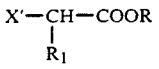

wherein

R and $R_1$ have the meanings given above and X' represents a chlorine bromine and iodine atom.

4. The process of claim 3 wherein R is an alkyl chain.

5. The process of claim 4 wherein said alkyl chain contains from 1–8 carbon atoms.

6. The process of claim 3 wherein $R_1$ is an alkyl chain.

7. The process of claim 6 wherein said alkyl chain contains 1–4 carbon atoms.

8. The process of claim 3 wherein $R_2$ is an alkyl chain.

9. The process of claim 8 wherein said alkyl chain contains 1–4 carbon atoms.

10. The process of claim 3 wherein X is a bromine or iodine atom.

11. The process of claim 3 wherein $R_1$ is hydrogen or methyl.

12. The process of claim 3 wherein $R_3$ and $R_4$, together with the carbon atoms to which they are bonded, form a substituted or unsubstituted aromatic cyclic or heterocyclic radical.

13. The process of claim 12 wherein $R_3$ and $R_4$, together with the carbon atoms to which they are bonded form a substituted or unsubstituted phenyl or naphthyl ring.

14. The process of claim 1 wherein said catalyst based on nickel complexed with a binitrogenous bidentate organic ligand is obtained by mixing a nickel salt and a binitrogenous bidentate organic ligand.

15. The process of claim 14 wherein said binitrogenous bidentate organic ligand is 2,2'-bipyridine.

16. The process of claim 14 wherein the mixture of said nickel salt and said binitrogenous bidentate organic ligand is produced in situ in the reaction mixture for the electrosynthesis of the beta, gamma unsaturated ester.

17. The process of claim 1 wherein said catalyst based on nickel complexed with a binitrogenous bidentate organic ligand is present in an amount ranging from 1 to 20 percent relative to the stoichiometric amount thereof for the reaction between said alpha, beta unsaturated halide and said alpha halogenated ester.

18. The process of claim 1 wherein said catalyst based on nickel complexed with a binitrogenous bidentate organic ligand is present in an amount of approximately 10% relative to the stoichiometric amount thereof for the reaction between said alpha, beta unsaturated halide and said alpha halogenated ester.

19. The process of claim 1 wherein said alpha halogenated ester is added progressively in the course of the electrolysis.

20. The process of claim 1 wherein no supporting electrolyte is added to the reaction mixture.

* * * * *